US012584074B2

(12) United States Patent
Metcalfe

(10) Patent No.: US 12,584,074 B2
(45) Date of Patent: Mar. 24, 2026

(54) BRIQUETTES

(71) Applicant: Binding Solutions Limited, Middlesbrough (GB)

(72) Inventor: Colin Metcalfe, Wynyard (GB)

(73) Assignee: Binding Solutions Limited, Middlesbrough (GB)

( * ) Notice: Subject to any disclaimer, the term of this patent is extended or adjusted under 35 U.S.C. 154(b) by 713 days.

(21) Appl. No.: 16/325,701

(22) PCT Filed: Aug. 14, 2017

(86) PCT No.: PCT/GB2017/052383
§ 371 (c)(1),
(2) Date: Feb. 14, 2019

(87) PCT Pub. No.: WO2018/033712
PCT Pub. Date: Feb. 22, 2018

(65) Prior Publication Data

US 2021/0340455 A1 Nov. 4, 2021

(30) Foreign Application Priority Data

Aug. 15, 2016 (GB) ..... 1613915

(51) Int. Cl.

| | |
|---|---|
| ***C10L 5/36*** | (2006.01) |
| ***C10L 5/10*** | (2006.01) |
| ***C10L 5/12*** | (2006.01) |
| ***C10L 5/14*** | (2006.01) |
| ***C10L 5/32*** | (2006.01) |
| ***C10L 9/10*** | (2006.01) |
| ***C10L 10/00*** | (2006.01) |

(52) U.S. Cl.
CPC ..... *C10L 5/361* (2013.01); *C10L 5/105* (2013.01); *C10L 5/12* (2013.01); *C10L 5/14* (2013.01); *C10L 5/32* (2013.01); *C10L 9/10* (2013.01); *C10L 10/00* (2013.01); *C10L 2250/06* (2013.01); *C10L 2290/24* (2013.01); *C10L 2290/30* (2013.01)

(58) Field of Classification Search
CPC .... C10L 5/105; C10L 5/12; C10L 5/14; C10L 5/32; C10L 5/361; C10L 9/10; C10L 10/00; C10L 2250/06; C10L 2290/24; C10L 2290/30
See application file for complete search history.

(56) References Cited

U.S. PATENT DOCUMENTS

| | | | | |
|---|---|---|---|---|
| 3,941,583 | A | 3/1976 | Martin et al. | |
| 4,169,711 | A | 10/1979 | Anderson | |
| 4,497,661 | A | 2/1985 | Valenti | |
| 4,586,936 | A | 5/1986 | Schaeffer et al. | |
| 4,863,485 | A * | 9/1989 | Scafer | C10L 5/10 44/553 |
| 4,981,494 | A * | 1/1991 | Breuil | C10L 5/10 44/554 |
| 5,244,473 | A | 9/1993 | Sardessai et al. | |
| 5,298,040 | A | 3/1994 | Gosset et al. | |
| 5,698,007 | A | 12/1997 | Schmitt | |
| 5,893,946 | A * | 4/1999 | Landis | B22C 9/00 106/38.22 |
| 6,071,325 | A * | 6/2000 | Schmitt | C22B 1/244 106/205.9 |
| 8,127,930 | B2 | 3/2012 | Wright et al. | |
| 2008/0255290 | A1* | 10/2008 | Rath | C09K 3/22 524/557 |
| 2009/0312448 | A1* | 12/2009 | Symons | C04B 35/6316 525/61 |
| 2014/0190310 | A1 | 7/2014 | Tooge et al. | |
| 2018/0179461 | A1* | 6/2018 | Michailovski | C10L 5/14 |

FOREIGN PATENT DOCUMENTS

| | | | | |
|---|---|---|---|---|
| AU | 2015290517 | B2 * | 1/2019 | C10L 5/48 |
| CA | 2869942 | A1 | 10/2013 | |
| CN | 1036233 | A | 10/1989 | |
| CN | 101671752 | A | 3/2010 | |
| DE | 2062747 | A1 * | 12/1970 | B01J 2/28 |
| DE | 3335241 | A1 | 4/1985 | |
| EP | 0135784 | A2 | 4/1985 | |
| EP | 0237179 | A2 | 9/1987 | |
| EP | 0252332 | A2 | 1/1988 | |
| EP | 0284252 | A1 | 9/1988 | |
| EP | 1013747 | A2 | 6/2000 | |
| FR | 2602778 | A1 | 2/1988 | |
| GB | 891731 | A | 3/1962 | |
| GB | 2213830 | A | 8/1989 | |
| JP | 2010007182 | A * | 1/2010 | |
| KR | 2013034492 | A * | 4/2013 | |
| WO | WO-9713827 | A1 * | 4/1997 | C10L 5/14 |
| WO | 2010035289 | A1 | 4/2010 | |
| WO | WO-2016010243 | A1 * | 1/2016 | C10L 5/48 |
| WO | WO-2016189044 | A1 * | 12/2016 | C10L 5/14 |

OTHER PUBLICATIONS

Gu et al., "Green Technology & Experience", Tongji University Press, May 31, 1990, p. 159.
Xu et al., "Briquette Technology", China Coal Industry Publishing House, Nov. 30, 2001, p. 77.
International Preliminary Report on Patentability for International Application No. PCT/GB2017/052383, Report issued Feb. 19, 2019, Mailed Feb. 28, 2019, 10 Pgs.

(Continued)

*Primary Examiner* — Latosha Hines
(74) *Attorney, Agent, or Firm* — Meunier Carlin & Curfman LLC

(57) ABSTRACT

The invention also provides a briquette comprising:

(i) a particulate material; and (ii) a binder, the binder comprising (a) at least partially saponified polyvinyl alcohol and (b) an alkali metal alkyl siliconate or polyalkylsilicic acid; wherein the particulate material is selected from a carbonaceous material, metal, metal ore, mineral waste or a mixture thereof.

15 Claims, No Drawings

(56) References Cited

OTHER PUBLICATIONS

International Search Report and Written Opinion for International Application No. PCT/GB2017/052383, Search completed Oct. 5, 2017, Mailed Dec. 21, 2017, 15 Pgs.
Database WPI Week 198710 Thomson Scientific, London, GB; AN 1987-068165 & JP S62 20836 A (NEOS KK) Jan. 29, 1987.
Database WPI, Week 201120 Thomson Scientific, London, GB; AN 2011-C32473 & JP 2011 047006 A (Nippon Steel & Sumitomo Metal Corp) Mar. 10, 2011.
Li, "Common Knowledge 3: "Practical Technology for Chemical Small Products (III)"", Tianjin Science and Technology Press, Mar. 1993. p. 201.
Wang, "Common Knowledge 2: "Green Degradation Chemicals"", Scientific Technical Documentation Press, Jan. 2008. p. 189.
Search report for UAE Patent Application No. P6000222/2019, date of search Aug. 29, 2024, 2 pg.

* cited by examiner

BRIQUETTES

This application is a national stage of PCT Patent Application No. PCT/GB2017/052383, entitled "Briquettes" to Metcalfe, filed Aug. 14, 2017, which claims priority to United Kingdom Application No. 1613915.6, entitled "Briquettes", filed Aug. 15, 2016, the disclosures of which are incorporated by reference herein in their entirety.

The present invention relates to the production of briquettes, for example from coal, metal or metal ores. Typically, the briquettes are formed from powdered material and utilised binders such as at least partially saponified polyvinyl alcohol (PVA) and an alkali metal alkyl siliconate or polyalkylsilicic acid; formaldehyde resins, polyacrylamide; and styrene acrylic emulsions. The briquettes are typically cold cured but are still capable of being used in blast furnaces.

There are a considerable quantity of powdered minerals worldwide. These wastes result from mining manufacturing and power generation processes and represent considerable potential resource for energy or metal manufacturing. One potential problem of such powdered materials is that they are extremely difficult to transport in the powder form and, for example, coal dust in a powdered form represents a potential explosion hazard.

Additional problems with such materials include that simply adding the powder materials to a combustion chamber or, for example, a blast furnace or direct reduced iron (DRI), results in the consumption of the material before it reaches the optimum part of the combustion chamber or furnace.

There is therefore a need to be able to bind the powder material together to allow it to be successfully transported or to allow it to be utilised within, for example, blast furnaces.

The use of, for example, saponified PVA in combination with molasses, has been used to assist in the production of coal and coke briquettes comprising calcium carbonate (DE 3335241). The use of other additives to the PVA, such as starch, has also been described (EP 0252332) and also other variations of utilising PVA as a binder (U.S. Pat. No. 4,586,936 and EP 0284252).

Additionally, it is also known to utilise other binders, such as sodium silicate (U.S. Pat. No. 4,169,711) with such particulate material. Such silicates may be used in concentrations as high as 30% wt.

Metal briquettes can also be formed by sintering metal dust or finings. However, this takes a large amount of energy to sinter such material.

Problems associated with such binding agents include that the resistance of the briquettes to moisture, for example from rainfall falling on the finished briquettes, is often limited. Moreover, it is desirable for the briquette to have the ability to resist damage during transport, for example, by being dropped from conveyor belts or other transport systems. The briquette must be retain its integrity as it passes through the furnace into the melting furnace, otherwise its performance in, for example, blast furnaces or DRI plants, can be adversely affected. Typically in the art, cement or clay-type binders are used for this purpose. However, the yield of the furnaces reduced due to the volume of the briquette that is lost due to the replacement of some of the coal by cement or clay. Moreover the presence of the cement of clay increases the amount of silica in the iron and the slag produced at the end of the process.

There are other more practical problems associated with other binders, such as the use of starches in the process as, for example, starches are typically expensive or hard to come by in the large quantities required for the large amounts of particulate materials that are available to be used with such processes.

The current invention is directed to the identification that mixing a variety of different binders can produce briquettes having excellent structural properties that lend themselves to be able to be used in, for example, blast furnaces and for the use in the production of power.

A first aspect of the invention provides a briquette comprising:

(i) a particulate material; and (ii) a binder, the binder comprising (a) at least partially saponified polyvinyl alcohol (PVA) and (b) an alkali metal alkyl siliconate or polyalkylsilicic acid;

wherein the particulate material is selected from a carbonaceous material, metal, metal ore, mineral waste or a mixture thereof.

The carbonaceous material may, for example, be coke, graphite, carbon black, peat or coal. Coal may be any grade of coal, including lignites, sub-bituminous coal, bituminous coal, steam coal or anthracite.

Mineral wastes include mill scale, mill sludges, fines from ores or metal containing wastes.

The metal may be, or the metal ore mineral waste, may contain iron, zinc, nickel, copper, chromium, manganese, gold, platinum, silver, titanium, tin, lead, vanadium, cadmium, beryllium, molybdenum, uranium or mixtures thereof or elemental metal or in the form of, for example, oxides or silicates.

Polyvinyl alcohol is typically commercially formed from polyvinyl acetate by replacing the acetic acid radical of acetate with a hydroxyl radical by reacting the polyvinyl acetate with sodium hydroxide in a process called saponification. Partially saponified means that some of the acetate groups have been replaced by hydroxyl groups and thereby forming at least a partially saponified polyvinyl alcohol containing vinyl alcohol residues.

Typically, the PVA has a degree of saponification of at least 80%, typically at least 85%, at least 90%, at least 95%, 98%, 99% or 100% saponification. PVA may be obtained commercially from for example, Kuraray Europe GmbH of Frankfurt Am Main, Germany.

Typically it is utilised as a solution in water. The PVA may be modified to include a sodium hydroxide content.

Typically the PVA binder has an active polymer content of 12-13% and a pH in the range 4-6 when in solution.

Typically the briquette contains 0.01-0.8% by weight of PVA. More typically it contains 0.5% by weight or 0.4% or 0.3% by weight PVA.

The alkali metal alkyl siliconate may be an alkali metal $C_1$ to $C_4$ alkyl siliconate, such as an alkali metal methyl siliconate. Alternatively, the methyl group moiety may be replaced by an ethyl, propyl or butyl moiety.

Typically the alkali metal is a sodium or potassium, most typically potassium.

Most typically potassium methyl siliconate is used, for example, sold under the trade names Silres by Wacker Chemie GmbH. This has been found to create briquettes with better drop resistance or lignin sulphate. Moreover, it produces surprisingly heat stable briquettes with briquettes capable of substantially maintaining their shape in a reducing atmosphere of UP TO 1200° C.

Alkali metal alkyl siliconates typically react with carbon dioxide during a curing process to produce the equivalent polyalkylsilicic acid, such as a poly $C_1$ to $C_4$ alkyl silicic acid, such as poly methyl silicic acid. They are conventionally used as masonry waterproofing agents.

Typically 0.01% of the alkali metal alkyl siliconate or polyalkylsilicic acid, more typically 0.5% or 0.2% by weight of the material is used.

The applicant has also found that the addition of up to 15% by weight, typically 8% or 5% by weight of a metal ore or mineral waste, improves the strength of the briquette further. Typically the metal ore is, for example, and iron-containing ore, such as ferrous or ferric oxide.

The applicant has identified that using the specific siliconate or polysilicic acid, improves the strength of the material. That is, for example, it improves the green strength of the material and allows the briquette that is formed to survive drops and knocks during transportation processes and also to survive the heat of a furnace to allow it to progress info the melting zone of, for example, a blast furnace.

A second aspect of the invention provides a briquette comprising:

(i) particulate metal ore or metal containing waste, and (ii) a binder comprising 0.5 to 1.5 wt % phenol formaldehyde resin.

This has been found to be particularly successful at producing iron-ore containing briquettes, such as from iron ore finings, meeting BS 4696-2 static reduction disintegration index, and compressive strength tests.

Phenol formaldehyde resins are generally known in the art. Typically the resin is a resole resin made with formaldehyde to phenol ratios of greater than 1, typically around 1.5.

The resin may be mixed into the finings as powder or as an aqueous solution.

The iron ore may be any naturally or non-naturally occurring ore, such as haematite, magnetite, or wustite any may contain naturally occurring contaminants.

Typically twin-shaft batching mixers are used to agglomerate the mixture. A roller press is typically used to form the briquettes. Continuous mixers do not typically control the material quantities accurately enough.

PVA may be optionally added from typically 0.1 to 0.2 wt %, especially 0.125% by weight. PVA may be as defined above.

Guar gum may he added together with or instead of PVA at typically 1.05 wt % to 1 wt %, typically 0.5 wt %.

Guar gum is a commercially available galactomannan gum. Typically 5000 cps grade is used.

A third aspect of the invention provides:

A briquette comprising (i) particulate, especially superfine iron residues; and (ii) a binder comprising 0.5-1.0 wt % anionic polyacrylamide.

The particulate iron residues are typically from tailing ponds or wash systems and typically are superfine. That is they have at least 90% below 200 microns and typically at least 50% below 20 microns as measured by $Fe_2O_3$ content. The iron residues arc typically iron oxides.

Twin batch mixers are typically used to agglomerate the mixture with roller presses used to form the briquettes.

Guar gum may be added at 4-12, most typically 5-10 or 8 parts polyacrylamide to 1 part guar gum by weight. Typically 3 parts calcium oxide may be added.

A fourth aspect of the invention provides a briquette comprising:

(i) a particulate carbonaceous material; a binder comprising (ii) 0.5 wt % to 1.5 wt % typically 1% wt/wt styrene acrylate emulsion and (iii) 5 to 10 wt % typically 8% inorganic cement.

The carbonaceous material may be as defined above but is typically coke, such as a lignite coke. Such cokes have been found to be particularly problematic at forming briquettes. The combination of the styrene acrylate emulsion and cement has been found to produce coke briquettes with good properties.

Where coke is used, such as lignite coke, the coke particles may be pre-treated with a guar gum solution, typically 35% of a 1% gum solutions, where the concentration is 1% wt/wt guar gum in water. The addition is 35% of the weight of the coke material. This has been found to reduce to porosity of the coke prior to mixing with the styrene acrylate emulsion and cement.

It should be noted that the term "briquette" includes objects commonly referred to as pellets, rods, pencils, briquettes and slugs. These objects share the common features of being a compacted form of material and arc differentiated principally by their size and shape.

The particulate material is typically of a diameter of 4 mm or less. Typically at least 10% by weight of particulate material is capable of passing through a 100 μm sieve prior to forming into a briquette. The presence of the smaller particles of the particulate material improves the packing of the material.

Alkali metal alkyl siliconates are generally known in the art as waterproofing agents, rather than the materials that impart some structural or binding capability. However, a further benefit of using such siliconates is that they impart some waterproofing property to the briquette and import some resilience to the presence of moisture.

Typically the briquette comprises <15%, <10% or <5% by weight of water.

Water content may be reduced by drying as, for example, adding burnt lime (calcium oxide) at up to typically 3%.

The applicant has found that the strength and resilience of the briquette made using the first aspect of the invention, can be further improved by addition of a suitable cross-linking agent. Suitable cross-linking agents include, for example, glutaraldehydes, for example at 0.01 to 5% w/w. Sodium hydroxide, for example 0.1% weight/weight, may also be used as a cross-linking agent. Other cross-linkers for PVA include glyoxal, glyoxal resin, PAAE resin (polyamidoamine epichlorohydrine), melamine formaldehydes, organic titanates (eg Tizor™, Du Pont), boric acid, ammonium, zirconium carbonate and glutaric dialdehyde-bis-sodium bisulphate. Typically up to 5% and more typically 3% or 2% by weight of the cross-linking agent is used. This allows, for example, the amount of PVA to be reduced from, for example, 0.8% by weight or 0.5% by weight to, for example, 0.3% by weight or 0.4% by weight PVA. This is a cost effective way of improving the strength of the material.

The water resistance of the briquette of the invention may be further improved by, for example, providing a waterproofing agent, such as a layer of waterproofing agent. Waterproofing agent is typically sprayed onto the outer surface of the briquette after the briquette has been formed. Typically waterproofing agents include styrene-acrylate copolymers such as Vinnapas™ SAF 34 (Wacker Chemie AG, Munich, Germany) which is typically a fine particles dispersion of a styrene acrylate copolymer, typically free from alkyl phenol ethoxylate, optionally this may contain 0.05 to 1% guar gum.

Alternatively the briquettes may be coated by spraying with a layer of bituminous emulsion.

An alternative to spraying of the briquettes with the materials includes, for example, dipping the briquettes in a solution or dispersion of the waterproofing material, or combining the waterproofing material with the particulate material and the binder.

A wetting agent or surfactant, such as a soap solution may be used to assist the wetting of the particulate material. This may be included at up to 1% by weight or 0.5% or 0.1% by weight. The binders crosslinking agent and waterproofing agents may be provided as aqueous solutions prior to use with the particulate material.

Typically, the briquettes comprise the binder, and optionally the cross-linking agent and/or the waterproofing agent where used, the remaining material being the particulate material and any moisture present in the material. Typically at least 70%, at least 80%, at least 90% or at least 95% of the briquette is particulate material as defined above.

The invention also provides a method of producing a briquette according to the invention comprising mixing the particulate material with binders as defined above:

compressing the mixture to form a briquette; and curing the briquette.

Compressing may, for example, be the use of a mould or alternative, for example, by roller-pressing or extruding the material.

The use of a vacuum may optionally be used to improve the uptake of the binder into the particulate material; however, it has been found by the applicant that this is not typically necessary.

A surfactant may be used to aid in wetting the particulate material.

Once the briquette has been formed it may be sprayed with a further waterproofing agent, for example, as defined above, or dipped in the waterproofing agent.

The briquette may then be allowed to cure, for example, for 12, 24 or 48 hours.

Typically the process is carried out at ambient temperatures, for example, 20 to 40° C., 0 to 30° C., 15 to 25° C. or 20° C.

The inventors have also found that particulate materials such as those defined above, especially metal, metal ore or mineral wastes, may be made into briquettes using a mixture of fully hydrolysed PVA, partially hydrolysed PVA and a cross linker.

A fifth aspect of the invention provides a briquette comprising:

(i) a particulate material; and (ii) a binder comprising (a) 0.01-0.5% by total weight fully saponified PVA, (b) 0.01-0.5% by weight partially saponified PVA and (c) 0.01 to 5% by weight of crosslinking agent.

The particulate briquette, PVA and crosslinking may be as defined above and maybe made as defined above, typically a 1:1 ratio by weight of fully saponified:partially saponified PVA is used. Typically 0.01 to 0.04%, especially 0.02% by weight of glutaraldehyde is used as the crosslinking agent. The particulate material may especially be a mineral waste.

It is generally known in the art to use PVA as a binder. It has been found that the selection of cross linker can improve the properties of briquettes. Hence a sixth aspect of the invention provides:

(i) a particulate material; and (ii) a binder comprising (a) 0.01-5% PVA and (b) 0.01 to 0.5% total w/w, especially 0.02% w/w sodium hydroxide.

Sodium hydroxide has been found to produce improved properties compared to, for example, glutaraldehyde, especially with metal ores and wastes, such as haematite. They may be used or made as defined above.

Some very finely powdered material wastes or mineral fines, such as an arc furnace mineral wastes, have been found to have problems being mixed with binding agents such as PVA. The inventors have found that the production of briquettes form such wastes can be advantageously made using a polysaccharide hinder such as starch, especially a pregelatinised potato starch to replace or he used in combination with PVA.

A seventh aspect of the invention provides a briquette comprising:

(a) a particulate mineral waste or fine, such as an arc furnace waste; and (b) a hinder comprising a polysaccharide binder.

The polysaccharide binder may be starch, it may be pregelatinised potato starch. It may be provided as up to 0.8% by weight of the briquette, especially 0.6% w/w, for example, by mixing 10% solution of the hinder with the mineral. Up to 0.5% w/w of PVA, as defined above, may be added.

Coke and coals dusts have been advantageously combined using phenol formaldehyde and a cross linker. An eighth aspect of the invention provides a briquette comprising:

(a) a particulate carbonaceous material such as coke or coal;

(b) a binder comprising phenol formaldehyde and a hardener.

The binder may be used in amounts up to 4% total w/w up to 2% w/w phenol formaldehyde may be typically used by fixing as an aqueous solution or with the hardener. The hardener may be, for example, glycol triacetate and a gum such as guar gum, acacia gum, gum arabic. Typically 0.1-0.5% w/w glycol triacetate and 0.1-0.5% w/w gum are used. This may be cold cured. Methods of forming the briquettes for this and other embodiments are also provided and may be carried out as defined above, optionally with one or more features such as briquette size, waterproofing etc. as described above.

The invention will now be defined by way of example only, with reference to the following examples:

The Addition of Waterproofing Agent to Coal Dust

Sasol coal dust of between 0 and 4 mm diameter particulate size with a 5% moisture content was tested with 0.5% PVA (e.g. Mowiol 47-88) in combination with a number of waterproofing additives. These were Goldcrest, Wacker DP 15, Silres 16 and Wacker DN 3109.

Briquettes of 30 mm size were produced by compressing.

Additionally, a bituminous emulsion was utilised with products. These were originally sprayed on to the briquettes, but it was later found that Silres could be mixed with the PVA and particulate material.

Briquettes that are sprayed with individual additives were allowed to cure for 28 hours and then immersed for 8 hours in water, removed and tested by a drop test.

The best of the waterproofing materials were bituminous emulsion and Wacker SAF 34. The latter is a styrene-acrylate copolymer.

Drop tests were dropped from 2 metres on to a concrete surface and had to survive a minimum of two drops in order to pass the test.

The Combination of Ferrous Fines and PVA and the Silres

Samples of ferrous fines, one sourced from the United States and one from South Africa, were tested. The US source was sized at 0-4 mm diameter and the South African source was graded as 0-2 mm, with moisture content at 0.5%. Fines were mixed with PVA 0.5% or less Mowiol 47-88 and Silres BS 16 0.02% in a laboratory Hobart mixer and then briquetted in a pressure briquetting plant.

The material from the United States was subjected to 8-10 tonne pressure produced specimens of approximately 180 gm which appear to he satisfactory. These were in a 40 mm die. The ex. South African material had 3.5% of burnt lime added and mixed vigorously. This survived a satisfactory drop test of 2 metres.

In further tests, the South African ferrous ore was used to study other aspects of the invention.

Trial 1

100 gm of ferrous ore (0.2 mm diameter) was accurately weighed into a mixing bowl. Surfactant was added (a couple of drops of soap solution). This was blended for one minute. A blended binder was prepared, comprising a 10% of 0.5% PVA solution (Mowiol 47-88 with 0.2% weight for weight Silres BS 16). 0.5% by weight of the solution was added to the ferrous ore and mixed for one minute. This was then compacted in a hydraulic press at 8 tonne using a 20 mm die and extruded. Specimens cured for 24 hours were found not to be completely cured with the centre of the specimen not fully cured. After 48 hours the specimen appeared sound Trial 2

The above experiment was repeated using 0.6% final weight of PVA and hydraulic pressed to 7-8 tonnes with a 20 mm die. After 24 hours the specimen appeared to have been totally cured.

Trial 3

100 gm of ferrous ore was mixed accurately into a bowl. Surfactant was added and mixed for one minute.

A blend of PVA 47-88 was mixed with Silres 16, but 5% of the 10% solution was added and mixed for one minute. This was extruded using a die press of 8 tonne with a 20 mm die. This showed an improvement over trials 1 and 2. This was burned and tested up to 1100° C. and proved to be satisfactory.

Trial 4

To above mixed material, the PVA binder was increased to 0.65% and mixed for one minute and extruded at 8 tonnes using a 20 mm die. Examination after extrusion showed the specimen was much stronger and gave a satisfactory solid sound effect. A bum test was satisfactorily completed.

Test 5

0.2 mm iron fines with a moisture content of 3.6% were also found to be successfully bound together using 0.4% PVA 0.02%. This material was successfully extruded using a 12 mm die and then cut into 12 mm lengths. Curing for 48 hours was found to improve the green strength of the material. It is noted that it is possible to reduce the total binder content to 0.35% or alternatively use a higher polymer solution such as 12.5% to reduce the amount of liquid present.

Waterproofing Test Using Anthracite Coal From South Africa

Powdered anthracite coal (0-4 mm) was mixed with a surfactant (0.01% w/w soap solution), sodium hydroxide 0.02% (w/w).

0.2% Silres BS 16 was mixed with the coal. The mixture was then hydraulically pressed using a 20 mm die to form briquettes.

With the absence of PVOH, the briquettes appear to be too dry and appear to lack mechanical strength. The addition of PVOH at 5% weight for weight produced a briquette which appeared to be sound and passed a 2 metre drop test.

This was repeated for Silres plus PVA plus glutaraldehyde as a cross-linker 0.02% (w/w). This was observed to improve the strength of the material.

Bitumen emulsion sprayed onto the briquette was observed to improve the waterproofing of the material.

Coal and Ferrous Oxide

The addition of up to 15% of particulate ferrous oxide containing material to coal, in combination with 0.5% PVOH and 0.2% Silres was found to improve the strength of the briquettes as tested by drop testing.

The Use of Fully and Partially Saponified PVA with Cross Linker

Test 1

Material:

Ferromanganese silicale slag—brittle with a significant metallic content. Lab processed to −4 mm size and minimum 20% passing 0.063 mm Source—Kazakhstan Blend:

Ferromanganese Silicate slag 0.25% w/w of fully saponified polyvinyl alcohol in a 10% solution 0.25% w/w of partially saponified polyvinyl alcohol in a 10% solution Glutaraldehyde xlinker 0.02% w/w 1% w/w water Mix was pressed 9 tonnes, 30 mm diameter Satisfactory specimens produced in respect of cold cure strength.

Specimens were placed in a muffle furnace at normal atmosphere up to 1100 c for 2 hours.

Specimens were very hard when cooled.

Effect of Crosslinkers on PVA

Test 1

Material to be agglomerated:

Un-beneficated iron ore (haematite) quarry fines −4 mm size. Contains silica and other minerals. Source—India Blend:

Quarry Fines 0.5% w/w of partially saponified polyvinyl alcohol in a 10% solution.

Glutaraldehyde xlinker 0.02% w/w

3% w/w water

Mix was pressed 9 tonnes, 30 mm diameter

Satisfactory specimens produced in respect of cold core strength. End user testing showed retained strength alter heating in a reducing atmosphere to 600 and 950 c was marginal.

Test 2

Material to be agglomerated:

Un-beneficated iron ore (haematite) quarry fines −4 mm size. Contains silica and other minerals. Source—India Blend:

100% Quarry Fines 0.455% of polyvinyl alcohol in a 12.5% solution

Sodium Hydroxide xlinker@0.02%

3% water

Mix was pressed 9 tonnes, 30 mm diameter

Satisfactory specimens produced in respect of cold cure strength. Retained strength after heating in a reducing atmosphere to 600 and 950 c was satisfactory:

Test Results

| Samples | 1 | 2 | Standard ref |
|---|---|---|---|
| Green Drop Test | Pass | Pass | Custom and practice |
| Shatter Test: 6 × 2 m Drop Test | >95%* | >94%* | In house 1 kg |
| Cold Tumbler | 99% | 99% | Derived from ISO3271 |

-continued

| Cold Compressive Strength Test | 250 kgf | 280 kgf | BS ISO 4700:2007 |
|---|---|---|---|
| Samples | 1 | | 2 |
| Reducing atmosphere yes/no | YES | | YES |
| Furnace Temperature | 600 | | 950 |
| Duration | 2 H | | 2 H |
| % Weight Loss | 7.0% | | 17.9% |
| % Retained after tumbler | 99 | | 96 |

Test 3

Test 2 was successfully up-scaled on a briquetting plant, 45 mm pillow briquettes demonstrated the same properties as the lab specimens Agglomeration of Fine Mineral Wastes Using Polysaccharide Binder Test 1

Material to be agglomerated:

Very fine (+40% −0.063 mm) dust, dry condition, arc furnace fines (EAF)

Source: South Africa COREX

Blend:

EAF 0.5% w/w of polyvinyl alcohol in a 10% solution

Xlinker glutaraldehyde 0.02% w/w

3% water

This binder was found to be incompatible with the dust, the PVoH dropped out of solution, due to alkalinity and/or trace elements such as boron in the EAF dust. Agglomeration not possible Test 2

Material to be agglomerated:

Very line (+40% −0.063 mm) dust, dry condition.

Source: South Africa COREX

Blend:

100% EAF dust (SA)

0.6% of organic, anionic polysaccharide binder 0.02% of glutaraldehyde

2% added water

Mix for 30 s, press 10 tonnes on 30×30 mm specimens.

The mix achieved satisfactory specimens which achieved the following properties:

Heat to 950 c in air 1 hour; retained strength, pass 2×2 m drop test

Heat to 950 c in a reduced atmosphere 2 hours—us above.

Heat from 600-1100 c in a reducing atmosphere—8 hours. Very hard specimens in region of 2.5 MpA compressive strength.

Test 3

Material to be agglomerated:

Iron-bearing fine dust from wet collectors on a direct reduced iron plant "DRI sludge".

Blend

DRI Sludge 100%

0.5% of anionic polysaccharide in 10% solution 0.02% of glutaraldehyde

3% added water 30 mm specimens visually Satisfactory (10 t load). Failed drop test.

Binder increased to 7%—drop test satisfactory—cracking started on 3$^{rd}$ drop.

Temperature test in a reducing atmosphere at 1000 c—satisfactory

Test 4

Material: fines from iron oxide pellet feed to direct reduction plant

100% oxide 0.6% of anionic polysaccharide 10% solution

Glutaraldehyde@0.02%

3% water

Unsatisfactory—fail drop test

Test 5

Material: fines from iron oxide pellet feed to direct reduction plant

100% oxide 0.6% of anionic polysaccharide 10% solution 0.3% of A in 10% solution Gluaraldehyde@0.02%

3% water

Unsatisfactory—fail drop test

Further test results are as follows:

Results of pellets post-reaction in DRI plant without coating material:

| Sample No | 1 | 3 | 10 |
|---|---|---|---|
| ccs kN | 1.16 | 3.6 | 1.74 |
| % Total Fe | 86.3 | 86.6 | 87.1 |
| % Metallisation | 94.2 | 90.3 | 93.9 |

Iron Ore Fines

Iron ore fines were agglomerated with hinder using a twin-shaft hatching mixer at a minimum speed of 45 rpm. A roller press was used to form the briquettes.

Mixture 1

4.0% of an aqueous phenol formaldehyde resin of the RESOL type and 30-40% solids was added to mined iron ore fines with grading of 0-4 mm. This was mixed and cylinder briquettes were produced at a pressure of 8 tonnes.

Mixture 2

A phenol formaldehyde resin of a resol type in a methanol carrier and having a sold content of 30-50% was emulsified as follows: 500 ml of a 30% solution of pvoh grade 4/80 was stirred at 450 rpm. 500 ml of the resin was added slowly. Then 2 ml of a 10% solution of pvoh was added.

The emulsion was verified by microscopy and remained stable for over 5 days@25 C The emulsion was diluted with water at 4:1 and 5% was mixed into mined iron ore fines. This was mixed and cylinder briquettes were produced at a pressure of 8 tonnes.

Mixture 3

A Phenol formaldehyde resin of RESOL type in powder form was blended with guar gum powder of grade 5000 cps. The ratio was 30 parts resin to 1 part gum. An aqueous solution was produced at by adding 300 g to 1 Litre of water whilst stirring. 5% was mixed into mined iron ore fines. This was mixed and cylinder briquettes were produced at a pressure of 8 tonnes.

Mixture 4

A 1% solution of guar gum powder of grade 5000 cps was produced. To this, 30% of A Phenol formaldehyde resin of RESOL type in powder form was added, whilst stirring. 5% was mixed into mined iron ore fines. This was mixed and cylinder briquettes were produced at a pressure of 8 tonnes Equipment for Reduction-Disintegration Testing Briquettes were placed on ceramic plinths in the centre of the heating zone and subjected to the gas flow. A maximum of 4 briquettes at a time could be tested (100-150 g).

A tumbler drum, of the specification ISO 4696-2 was loaned from BSL for the tests. Variable speed twin rollers were used to roll the drum, calibrated to 30 RPM.

These were agglomerated by twin-shaft batching mixer and formed into briquettes as described above.

Specification

Briquettes should have a strength of 150 kg/cm and withstand 30 Drops with max 10% loss Summary of Work 32 mm diameter cylinders were produced with different blend ratios and tested at the DTS laboratory, Stockton on Tees. UK Binder was added as powders to a wet iron slurry, typically composed of the following:

Anionic Polyacrylamide 8 parts

Guar gum 1 part

Calcium oxide 3 parts

Mixing was by a high speed and high shear mixer

Results size less than 20 mic

| Ref no | Added Moisture | Binder (wt %) | Strength kN | No. Drops, 2 m |
|---|---|---|---|---|
| 77/15a | 12 | BSL539→Phenol formaldehyde resole resin | 4.1 | 3 |
| 77/15b | 12 | BSL200→Polyacrylamide (anionic) | nd | 1 |
| 77/15c | 12 | BSL139→Phenol formaldehyde resin | 0.7 | 0 |
| 80/15a | 20 | BSL203→ Polyacrylamide | nd | 7 |
| 80/15b | 20 | BSL203→ Polyacrylamide | 1.5 | 15 |
| 80/15c | 15 | BSL201→Polyacrylamide | 2.2 | 15 |
| 80/15d | 20 | BSL201→ Polyacrylamide | 3.3 | 30+ |
| 80/15e | 20 | BSLCSF→Inorganic cement and silica fumed blend | 1.55 | 0 |
| 80/15f | 20 | BSL150→Sodium carboxylate solutiohn | 1.3 | 2 |

Particle size 150-20 microns

| Ref no | Added Moisture | Binder (wt %) | Strength kN | No. Drops, 2 m |
|---|---|---|---|---|
| 78/15A | 10 | BSL539→Phenol formaldehyde resole resin | 0.5 | 0 |
| 78/15B | 10 | BSL203→ Polyacrylamide | 1.3 | 10 |
| 81/15 | 10 | BSL203→ Polyacrylamide | 1.5 | 8 |
| 82/15 | 15 | BSL201→ Polyacrylamide | 3.2 | 18 |
| 84/15 | 15 | BSL201→ Polyacrylamide | 3.9 | +30 (20 mm pellet) |

Test Procedure

RDI test:

Tube temperature 550+/−10 C

Time in reduction zone 30 mins

Gas conditions 70% Nitrogen/30% Carbon Dioxide at approx. 300 Litres/hour

Time Cooling—1 hour in ceramic box

Tumbler—300 revolutions at 30 rpm/900 revolutions at 30 rpm

Results: Reduction Degradation Index

| mix No | Result RDI | Result Strength | Comments |
|---|---|---|---|
| 1 | 10 | 6.5 kN | good |
| 2 | 14 | 5 kN | good |
| 3 | 63 | 6.5 kN | Poor |
| 4 | 12 | 7 kN | good |

Superfine Iron Residues for Tailing Ponds/Wash Systems

Anaysis by XRF gave the following Fe contents (as $Fe_2O_3$):

Sub 20 microns 55.7%

150-20 microns 89.2%

80/15 d and 84/15 were upscaled to an extrusion pilot plant, number of drops +40.

Low Grade Coke (Lignin Based Coke)

A formulation for cold binding a low grade coke breeze which meets high temperature resistance, attrition resistance and cold handling strength Agglomeration was carried out using a batching mixer of a minimum speed of 45 rpm.

35% wt of a 1% gum solution was added to the coke, the grade of gum preferred is 5000 cps technical. This was used to fill at least some of the pores in the coke.

To this was added 1% of Styrene acrylic emulsion and mixed to make the coke bind.

8% wt of rapid hardening cement was added to give strength and heat resistance to the briquette.

Further treatment is required after the briquette process

A roller press was used so that the water/cement ratio is not affected on extrusion. Briquettes were left to cure for a few days, dependent on temperature. Ideally temperature was raised to 25 C, without too much handling of briquettes.

Further Treatment

A 1:4 solution of the styrene acrylic emulsion was prepared and the briquettes passed through the solution, e.g. by a dipping trough on a conveyor belt run. This adds around 1% raw chemical. This was allowed to dry. This adds resistance to abrasion and water resistance.

Test Results on Lab Prepared Samples

| Test | Result |
|---|---|
| Density | — |
| Compressive strngth | 1.45 kN |
| Water abs. | 21% |
| Compressive str after Water | 1.33 kN |
| Hot compressive strength | 0.62 kN |
| Abrasion | 90 |
| Drop test | 98.5 |

This shows that coke briquettes using poor quality coke can be produced which meet the necessary standards for use in, for example, furnaces.

The invention claimed is:

1. A briquette consisting essentially of:

a particulate iron ore; and a binder consisting of:

phenol formaldehyde resin, polyvinyl alcohol and a cross-linker, wherein the cross-linker is selected from glutaraldehyde, glyoxal, glyoxal resin, polyamidoamine, epichlorohydrine resin, melamine formaldehydes, organic titanates, and glutaric dialdehyde-bis-sodium bisulphate;

wherein the binder includes from 0.01 to 5% by weight of the cross-linker.

2. The briquette according to claim 1, wherein the briquette includes 0.01 to 0.8% by weight of PVA.

3. The briquette according to claim 1, wherein the briquette includes up to 99% by weight of the particulate iron ore.

4. The briquette according to claim 1, wherein the resin is a resole phenol formaldehyde resin.

5. The briquette according to claim 1, wherein the binder includes 0.1 to 0.2 wt % polyvinyl alcohol.

6. The briquette according to claim 1, wherein the particulate iron ore has a particle size of 4 mm diameter or less.

7. The briquette according to claim 6, wherein at least 10% by weight of the particulate iron ore is capable of passing through a 100 pm sieve prior to forming into a briquette.

8. The briquette according to claim 1, wherein the cross-linker is glutaraldehyde.

9. The briquette according to claim 1, wherein the briquette has a moisture content of <15% by weight.

10. A method for producing the briquette of claim 1, the method comprising:

mixing the particulate iron ore with the binder, compressing the mixture to form a briquette; and curing the briquette.

11. The method according to claim 10, wherein the iron ore has a moisture content of <15% by weight.

12. The method according to claim 10, further comprising coating the briquette with a waterproofing agent.

13. The method according to claim 12, wherein the waterproofing agent is sprayed on to the briquette.

14. The method according to claim 12, wherein the waterproofing agent comprises a styrene-acrylate copolymer or a bitumen emulsion.

15. The briquette according to claim 1, wherein the iron ore comprises haematite, or magnetite.

* * * * *